US012022967B2

(12) United States Patent
Ho et al.

(10) Patent No.: US 12,022,967 B2
(45) Date of Patent: Jul. 2, 2024

(54) PLASTIC HOOK FOR PAPER HANGER

(71) Applicant: Sourcing Solutions International Limited, Kowloon (HK)

(72) Inventors: Leung Ho, Kowloon (HK); Chi Man Leung, Kowloon (HK)

(73) Assignee: Sourcing Solutions International Limited, Kowloon (HK)

( * ) Notice: Subject to any disclaimer, the term of this patent is extended or adjusted under 35 U.S.C. 154(b) by 176 days.

(21) Appl. No.: 17/380,179

(22) Filed: Jul. 20, 2021

(65) Prior Publication Data

US 2022/0304490 A1 Sep. 29, 2022

Related U.S. Application Data

(63) Continuation-in-part of application No. 29/781,225, filed on Apr. 28, 2021, now Pat. No. Des. 961,278, and a continuation-in-part of application No. 29/775,576, filed on Mar. 24, 2021, now Pat. No. Des. 953,756, and a continuation-in-part of application No. 29/775,565, filed on Mar. 24, 2021, now Pat. No. Des. 953,045.

(51) Int. Cl.
*A47G 25/38* (2006.01)
*A47G 25/14* (2006.01)

(52) U.S. Cl.
CPC ..... *A47G 25/38* (2013.01); *A47G 25/1428* (2013.01)

(58) Field of Classification Search
CPC ..... A47G 25/1407; A47G 25/1414; A47G 25/1428; A47G 25/38
USPC ..... 223/87, DIG. 4
See application file for complete search history.

(56) References Cited

U.S. PATENT DOCUMENTS

| | | | | |
|---|---|---|---|---|
| 4,542,838 A * | 9/1985 | Perez-Tubens | ..... | A47G 25/16 223/87 |
| 2014/0252048 A1* | 9/2014 | Mainetti | ..... | A47G 25/32 223/85 |
| 2021/0307549 A1* | 10/2021 | Rhyner | ..... | A47G 25/483 |

FOREIGN PATENT DOCUMENTS

| | | | | |
|---|---|---|---|---|
| FR | 2758071 | 10/1998 | | |
| GB | 2328369 A * | 2/1999 | ..... | A47G 25/1407 |
| GB | 2396805 | 7/2004 | | |

OTHER PUBLICATIONS

SML Launches EcoHanger; Reducing Plastic Waste in Retail Garment Hangers by 50%; www.realwire.com (Oct. 1, 2019).
SuperGirl Plastic Hook (in use at least as early as Oct. 22, 2020).
Torkia Plastic Hook (in use at least as early as Oct. 22, 2020).

* cited by examiner

*Primary Examiner* — Nathan E Durham
(74) *Attorney, Agent, or Firm* — Schroeder Law PC

(57) ABSTRACT

A plastic hook for securement to a paper hanger body, and a method of assembling same. The plastic hook provides a sizer for displaying indicia about the garment, particularly a crown sizer.

7 Claims, 9 Drawing Sheets

A-A

50
B-B 10
12
14
18
A
B

PLASTIC HOOK FOR PAPER HANGER

BACKGROUND OF THE INVENTION

The present invention relates to hangers and, more particularly, to a plastic hook for use with and securement to a paper hanger body.

Garments sold in retail outlets are often displayed on a hanger. Plastic garment hangers having plastic hooks are well-known in the art. These hangers are typically formed as an integral unit using an injection molding process. Plastic garment hangers having metal hooks are also well-known in the art. However, today there is more and more interest in finding ways to reduce the amount of plastic used in the garment industry.

One such solution is referred to as a paper hanger. The body of a paper hanger is typically formed of cardboard or a similar paper stock material having sufficient strength to support the weight of the garment. Although there have been efforts to form the hook from the same cardboard material (by, for example, stamping the entire hanger/hook combination from a sheet of cardboard), it has been difficult to provide a hook having the strength necessary to support the weight of the garment.

As a result, manufacturers have first formed the body of the hanger from paper—and then attached a plastic hook or other hanging means thereto by for example, a rivet or other complex attachment structure. In addition to the lack of pleasing aesthetics found in these prior art paper hangers, there was also an inability to readily utilize a sizer therewith, particularly a crown sizer.

There is therefore a need in the art for a plastic hook which can be readily secured to a paper hanger body, which provides pleasing aesthetics, and which provides a sizer for displaying indicia about the garment, particularly a crown sizer.

SUMMARY OF THE INVENTION

The present invention, which addresses the needs of the prior art, provides a plastic hook for a paper hanger body. The paper hanger body includes a pair of opposing arms for supporting a garment thereon. The paper hanger body further includes an attachment opening extending therethrough. The plastic hook includes a hook body. The hook body includes a hanging arm having first and second ends. The first end of the hanging arm is sized to engage a rack. The hook body further includes an attachment base. The attachment base includes first and second opposing planar surfaces. The attachment base further includes a flange located along one edge thereof and extending in a direction X perpendicular to the first planar surface. The second end of the hanging arm is attached to the flange. The attachment base further includes a collar extending from the first planar surface in the direction X, the collar being sized to extend through the attachment opening in the paper hanger body. The plastic hook further includes a lock member. The lock member includes a sizer body portion and a tongue extending therefrom. The sizer body portion defines an interior opening sized and configured to allow passage of the hanging arm therethrough to a first position in which the sizer body portion is positioned at the second end of the hanging arm, the tongue being sized and configured to engage the collar thereby securing the plastic hook to the paper hanger body.

The present invention further provides a garment hanger. The garment hanger includes a paper hanger body. The paper hanger body includes a pair of opposing arms for supporting a garment thereon. The paper hanger body further including an attachment opening extending therethrough. The garment hanger further includes a plastic hook including a hook body and a lock member. The hook body includes a hanging arm having first and second ends. The first end of the hanging arm is sized to engage a rack. The hook body further includes an attachment base. The attachment base includes first and second opposing planar surfaces. The attachment base further includes a flange located along one edge thereof and extending in a direction X perpendicular to the first planar surface. The second end of the hanging arm is attached to the flange. The attachment base further includes a collar extending from the first planar surface in the direction X. The collar is sized to extend through the attachment opening in the paper hanger body. The lock member includes a sizer body portion and a tongue extending therefrom. The sizer body portion defines an interior opening sized and configured to allow passage of the hanging arm therethrough to a first position in which the sizer body portion is positioned at the second end of the hanging arm, the tongue being sized and configured to engage the collar thereby securing the plastic hook to the paper hanger body.

Finally, the present invention provides a method of assembling a plastic hook to a paper hanger body. The method includes the step of providing a paper hanger body, the paper hanger body including a pair of opposing arms for supporting a garment thereon, the paper hanger body further including an attachment opening extending therethrough. The method includes the further step of providing a plastic hook including a hook body and a lock member, the hook body including a hanging arm having first and second ends, the first end of the hanging arm being sized to engage a rack, the hook body further including an attachment base, the attachment base including first and second opposing planar surfaces, the attachment base further including a flange located along one edge thereof and extending in a direction X perpendicular to the first planar surface, the second end of the hanging arm being attached to the flange, the attachment base further including a collar extending from the first planar surface in the direction X, the collar sized to extend through the attachment opening in said paper hanger body, the lock member including a sizer body portion and a tongue extending therefrom, the sizer body portion defining an interior opening sized and configured to allow passage of the hanging arm therethrough, the tongue being sized and configured to engage the collar. The method includes the further step of positioning the first planar surface of the attachment base of the hook body against the paper hanger body such that the collar extends through the attachment opening and the flange engages an edge of the paper hanger body. The method includes the further step of installing the lock member by sliding the hanging arm through the interior opening of the sizer body portion and towards the second end of said hanging arm. Finally, the method includes the step of engaging the tongue with the collar to secure the plastic hook to the paper hanger body.

As a result, the present invention provides a plastic hook which can be readily secured to a paper hanger body, which provides pleasing aesthetics, and which provides a sizer for displaying indicia about the garment, particularly a crown sizer. The present invention further provides a method of assembling a plastic hook to a paper hanger body.

DETAILED DESCRIPTION OF THE INVENTION

Figure 1:
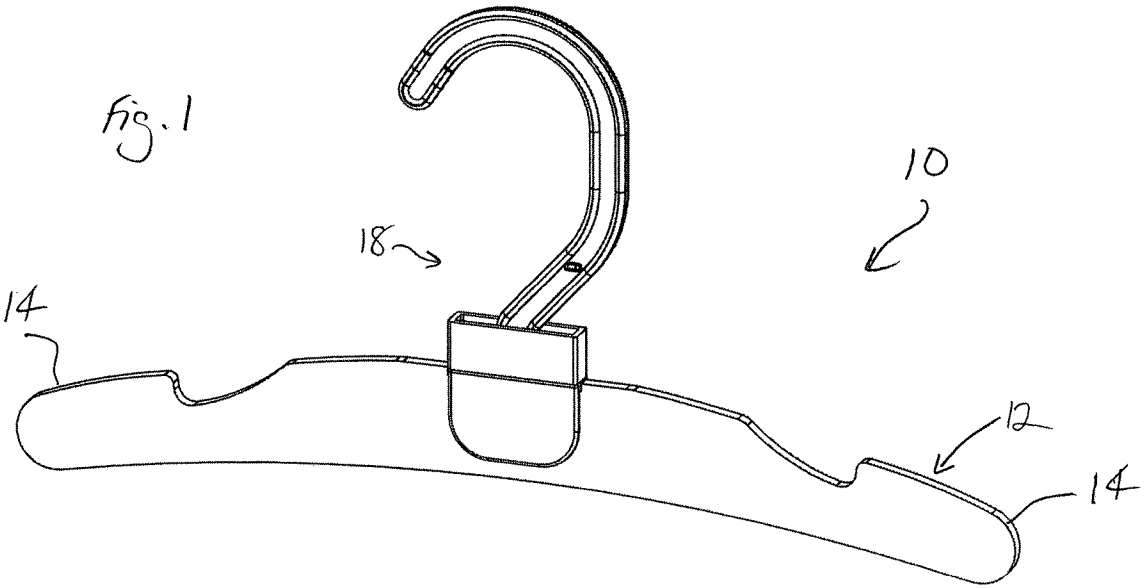
FIG. 1 is a front perspective view of a first embodiment of the plastic hook of the present invention secured to a paper hanger body.
Figure 2:
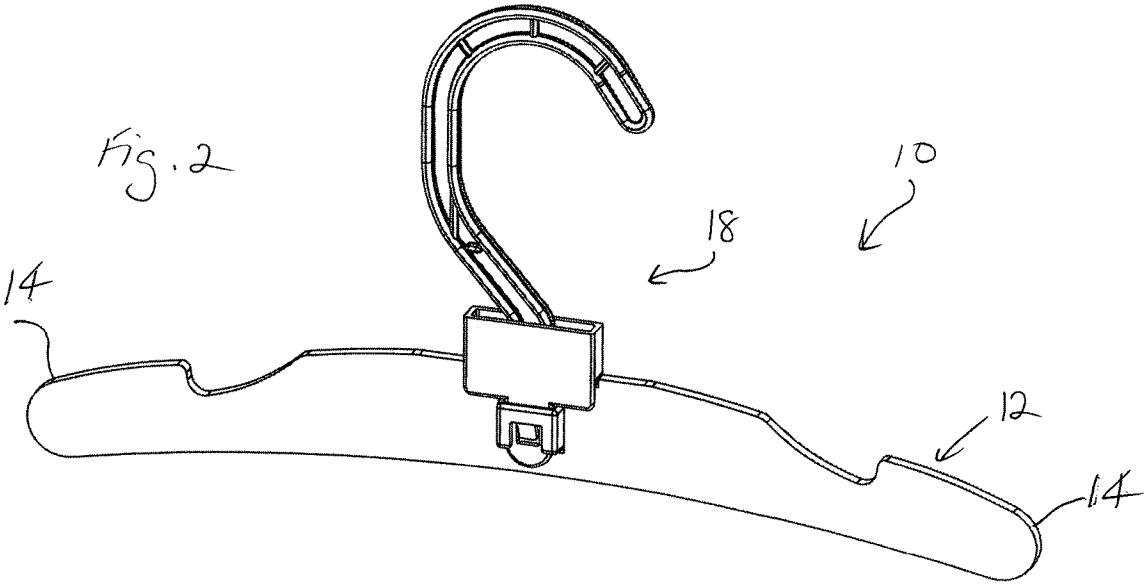
FIG. 2 is a rear perspective view of the plastic hook of FIG. 1.
Figure 4:
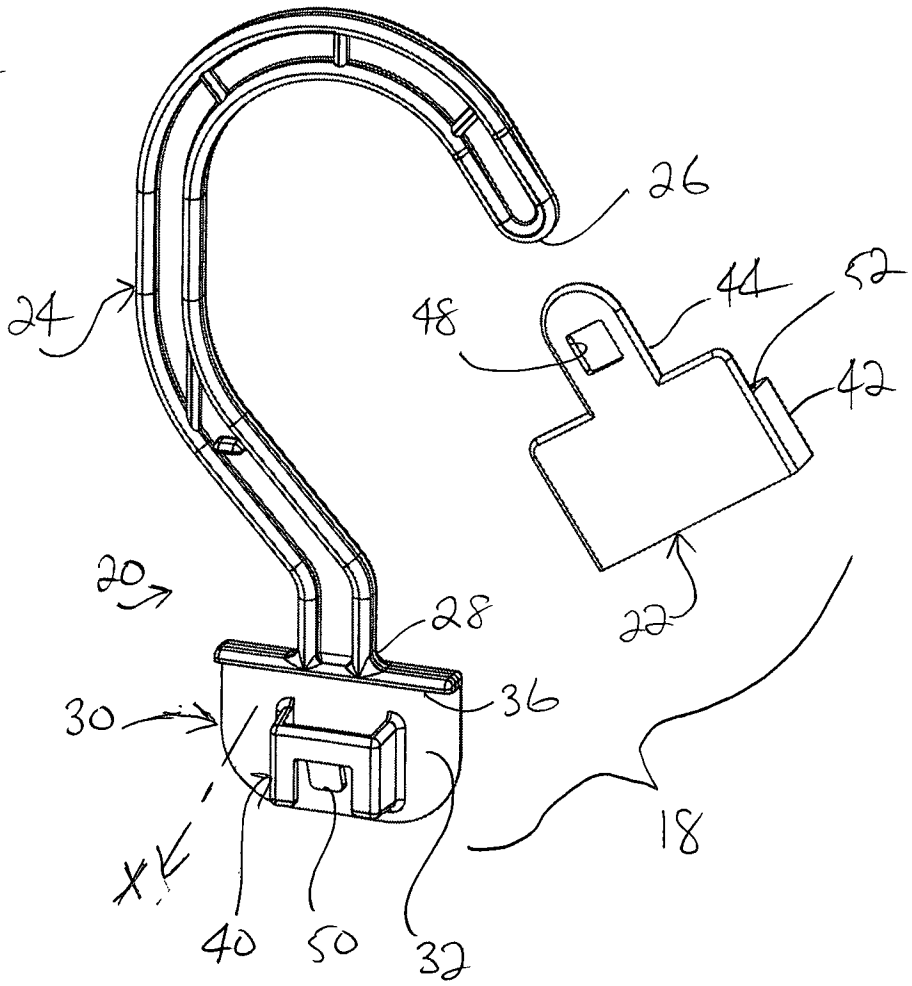
FIG. 4 is an enlarged rear perspective detail of the hook body with the lock member removed therefrom.
Figure 3:
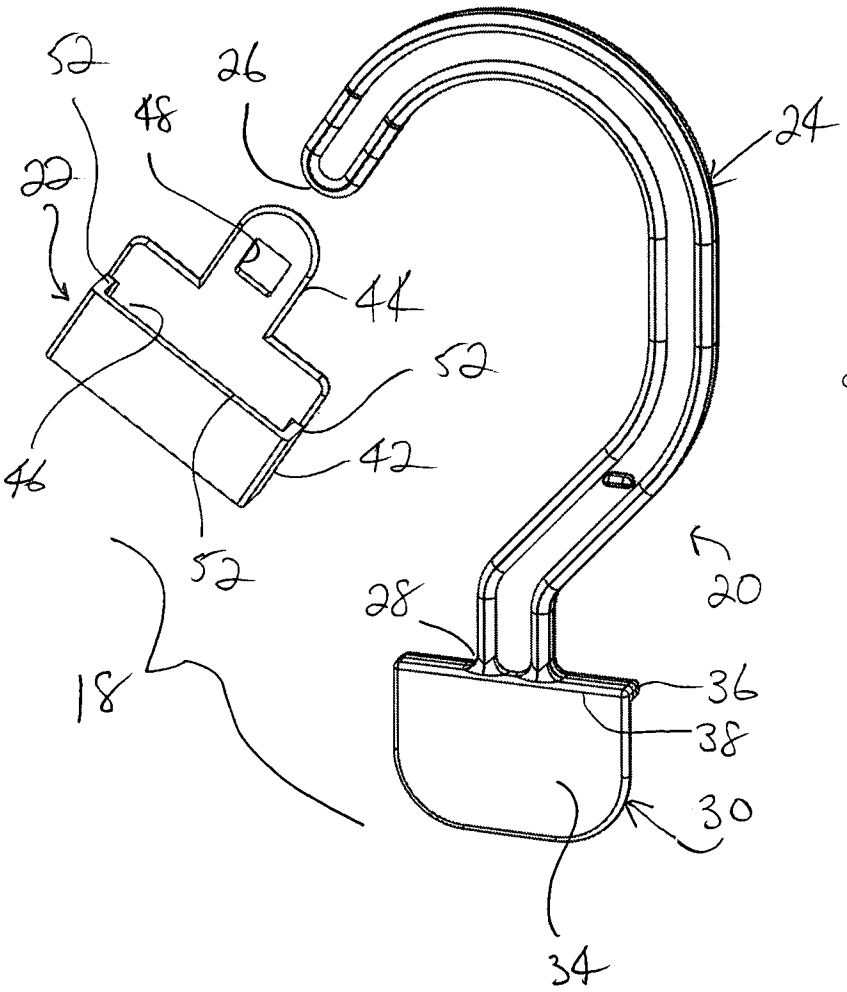
FIG. 3 is an enlarged front perspective detail of the hook body with the lock member removed therefrom.
Figure 6:
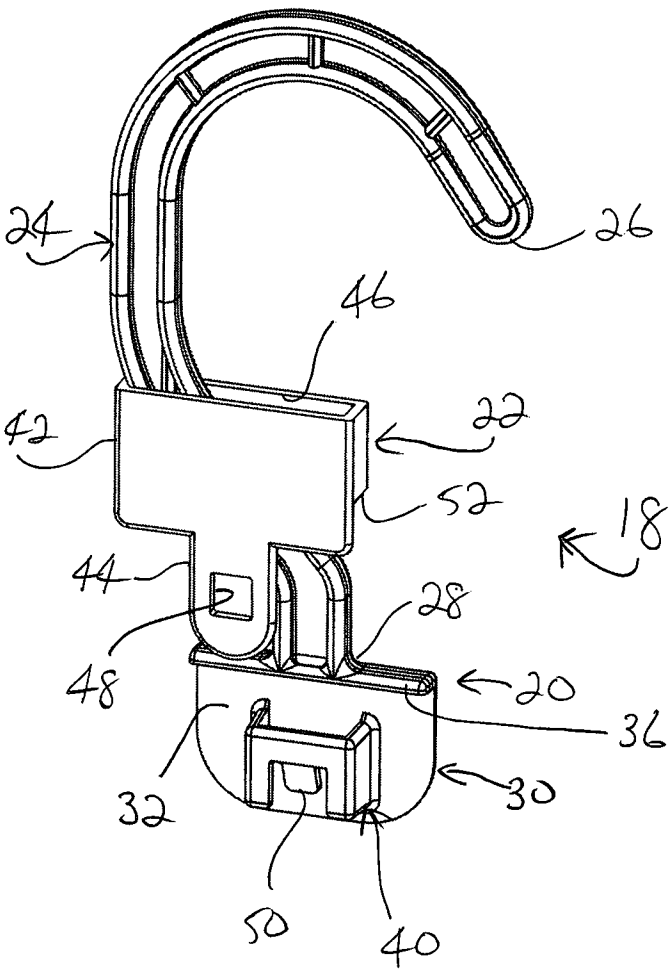
FIG. 6 is an enlarged rear perspective detail of the hook body with the lock member being installer thereover.
Figure 5:
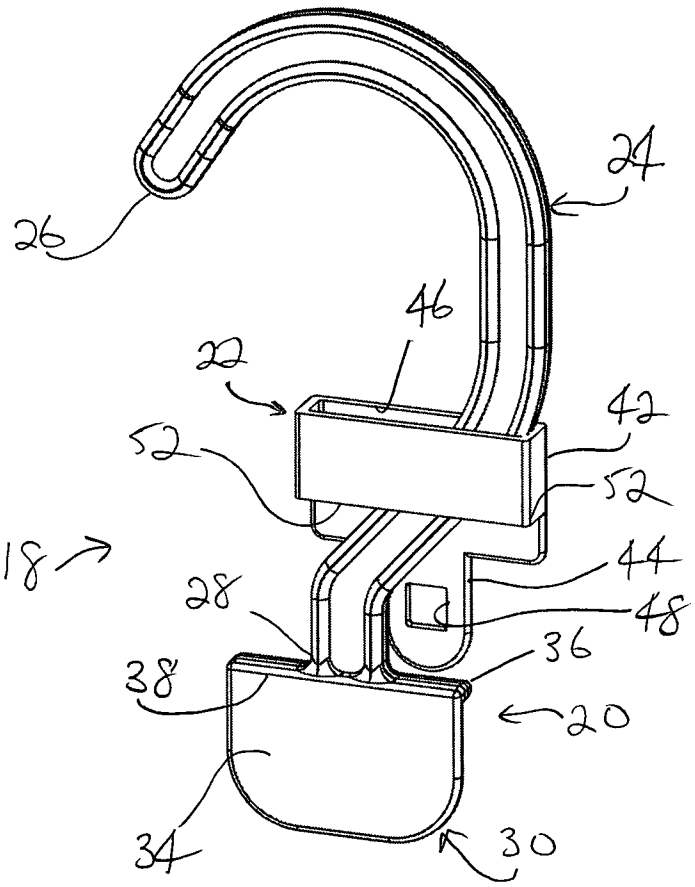
FIG. 5 is an enlarged front perspective detail of the hook body with the lock member being installed thereover.
Figure 7:
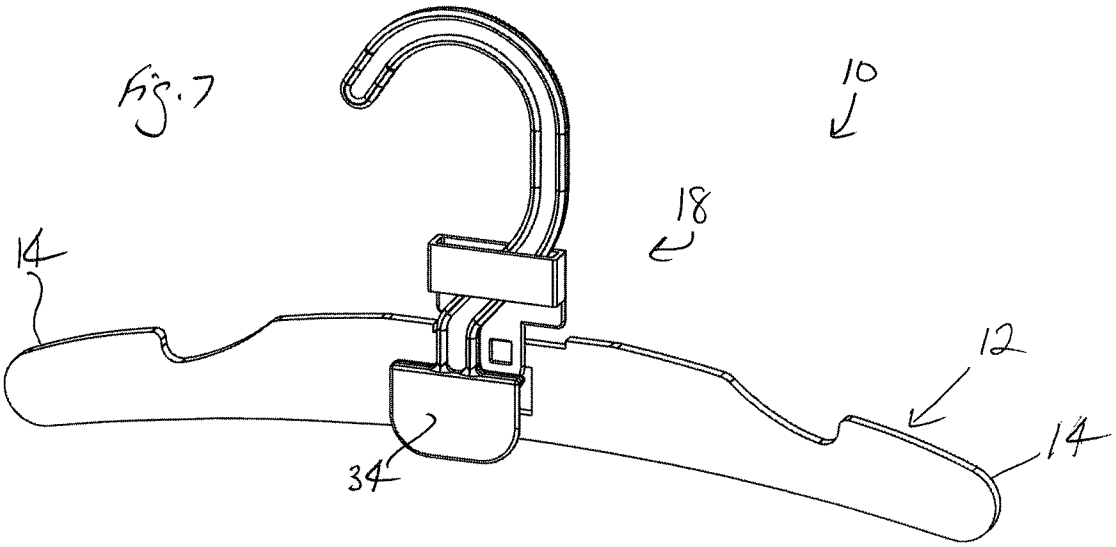
FIG. 7 is a view similar to FIG. 5 showing the hook body/lock member positioned for securement to the paper hanger body.
Figure 8:
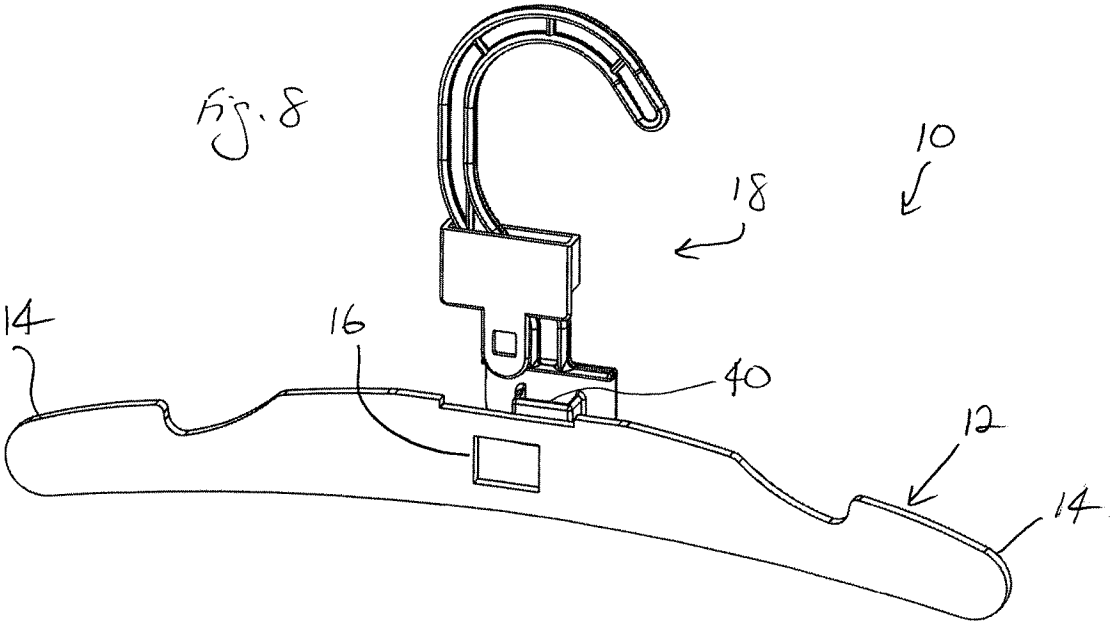
FIG. 8 is a view similar to FIG. 6 showing the hook body/lock member positioned for securement to the paper hanger body.
Figure 9:
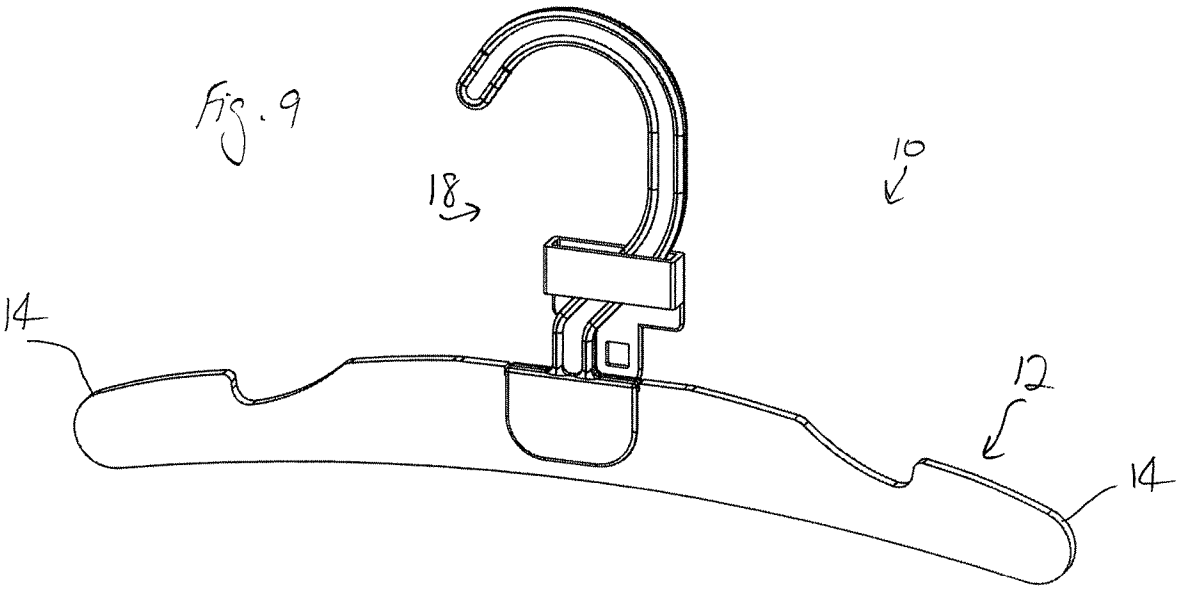
FIG. 9 is a view similar to FIG. 7 showing the hook body engaging the paper hanger body.
Figure 10:
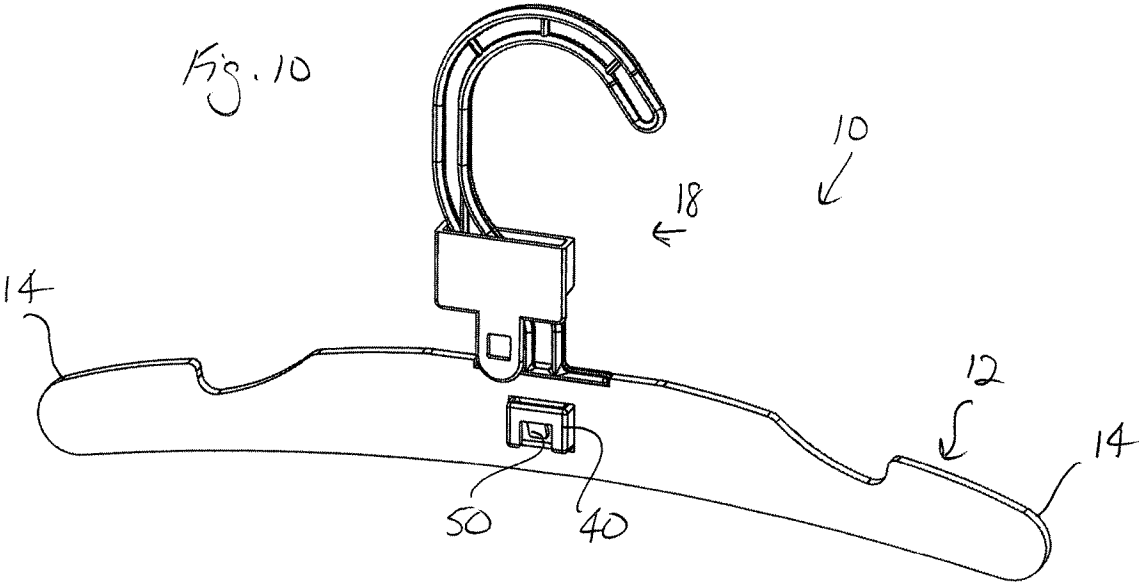
FIG. 10 is a view similar to FIG. 8 showing the hook body engaging the paper hanger body.
Figures 11, 11A, 12, 12A:
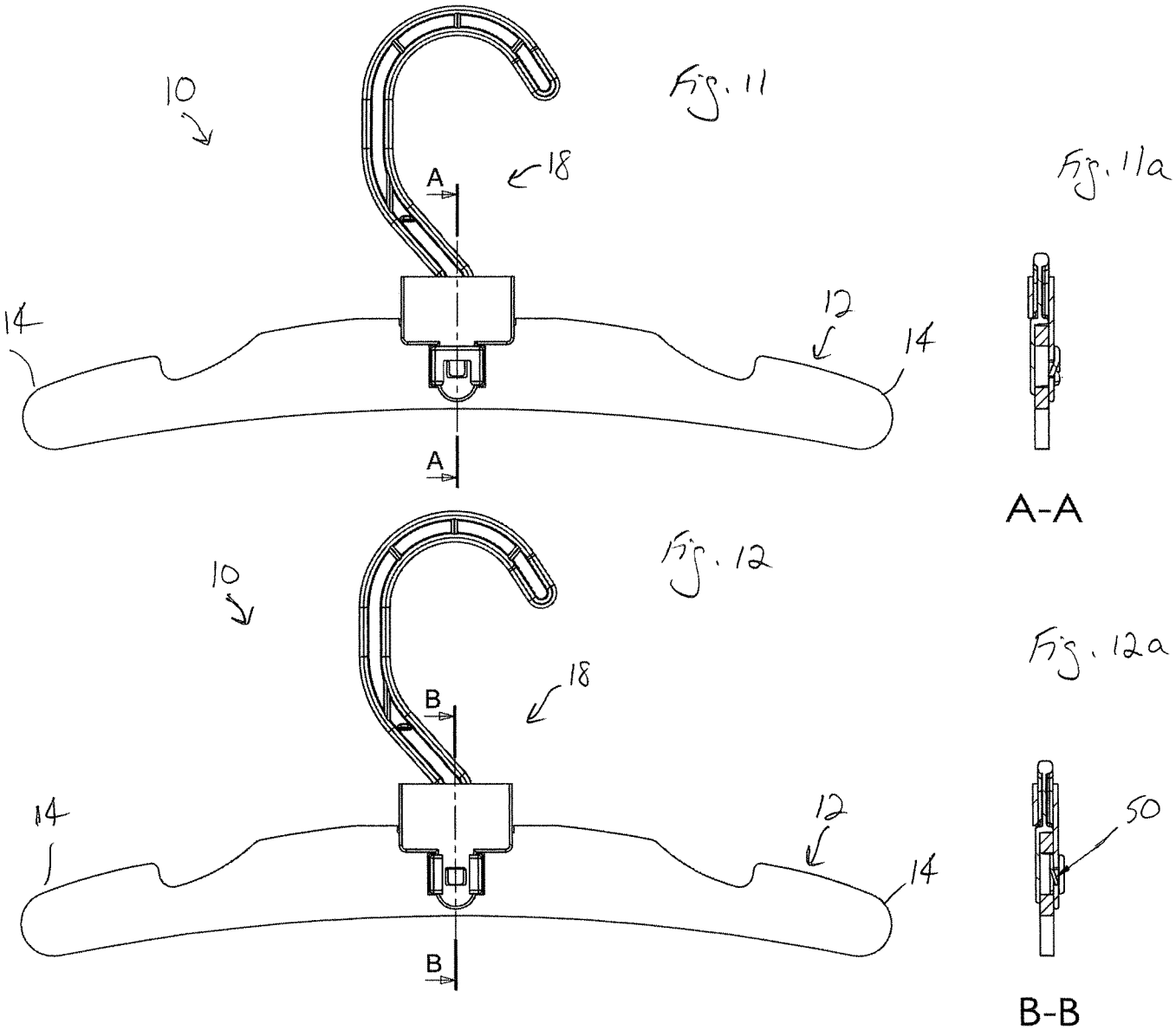
FIG. 11 is a view similar to FIG. 10 showing the tongue of the lock member engaging the collar extending through the paper hanger body.
FIG. 11*a* is a cross-sectional view taken along lines A-A of FIG. 11.
FIG. 12 is a view similar to FIG. 10 showing the tongue of the lock member engaging the collar extending through the paper hanger body and with a portion of the collar removed for clarity.
FIG. 12*a* is a cross-sectional view taken along lines B-B of FIG. 12.

A first embodiment of the present invention is shown in FIGS. 1 to 12. Hanger 10 includes a paper hanger body 12. Paper hanger body 12 includes a pair of opposing arms 14 for supporting a garment (not shown) thereon. Paper hanger body 12 includes an attachment opening 16 extending therethrough (best seen in FIG. 8). In one preferred embodiment, attachment opening 16 is rectangular in shape, and is located about an axis of symmetry extending through said paper hanger body 12. Paper hanger body 12 is preferably formed of cardboard or a similar paper stock material.

Hanger 10 further includes a plastic hook 18. Plastic hook 18 in turn includes a hook body 20 and a lock member 22. Hook body 20 includes a hanging arm 24 having a first end 26 and a second end 28. First end 26 is preferably sized and configured to engage a rack whereby the garment can be hung for display. Hook body 20 further includes an attachment base 30 having a first planar surface 32 and an opposing second planar surface 34. Attachment base 30 further includes a flange 36 located along edge 38 and extending in a direction X perpendicular to first planar surface 32. The second end of hanging arm 24 is connected to flange 36. In one preferred embodiment, hook body 20 is formed as a single, integral component. Attachment base 30 further includes a collar 40 extending outwardly from first planar surface 32 in direction X. In one preferred embodiment, collar 40 defines a substantially rectangular outline which is sized to correspond to attachment opening 16 such that collar 40 can extend through attachment opening 16. In one particularly preferred embodiment, collar 40 is sized to maintain frictional engagement with attachment opening 16 when installed therethrough.

Lock member 22 includes a sizer body portion 42 and a tongue 44 extending therefrom. Sizer body portion 42 is preferably formed of four connected walls defining a rectangular cross section and an interior opening 46 sized and configured to allow passage of hanging arm 24 therethrough such that sizer body portion 42 substantially surrounds second end 28 of hanging arm 24 and tongue 44 engages collar 40. However, it is contemplated herein that sizer body portion 42 may also be formed from three connected walls (e.g., by eliminating one of the shorter end walls) or from a substantially continuous curved wall whereby the sizer body portion substantially/completely encloses interior opening 46. In one preferred embodiment, tongue 44 includes an opening 48 and attachment base 30 includes a tab 50. Tab 50 is located and biased to engage opening 48 when tongue 44 is inserted within collar 40 thereby securing plastic hook 18 to paper hanger body 12. In another preferred embodiment, edge 52 of sizer body portion 42 contacts and rests against flange 36.

Figure 13A:
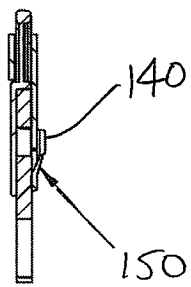
FIG. 13*a* is a cross-sectional view taken along lines C-C of FIG. 13.
Figure 13:
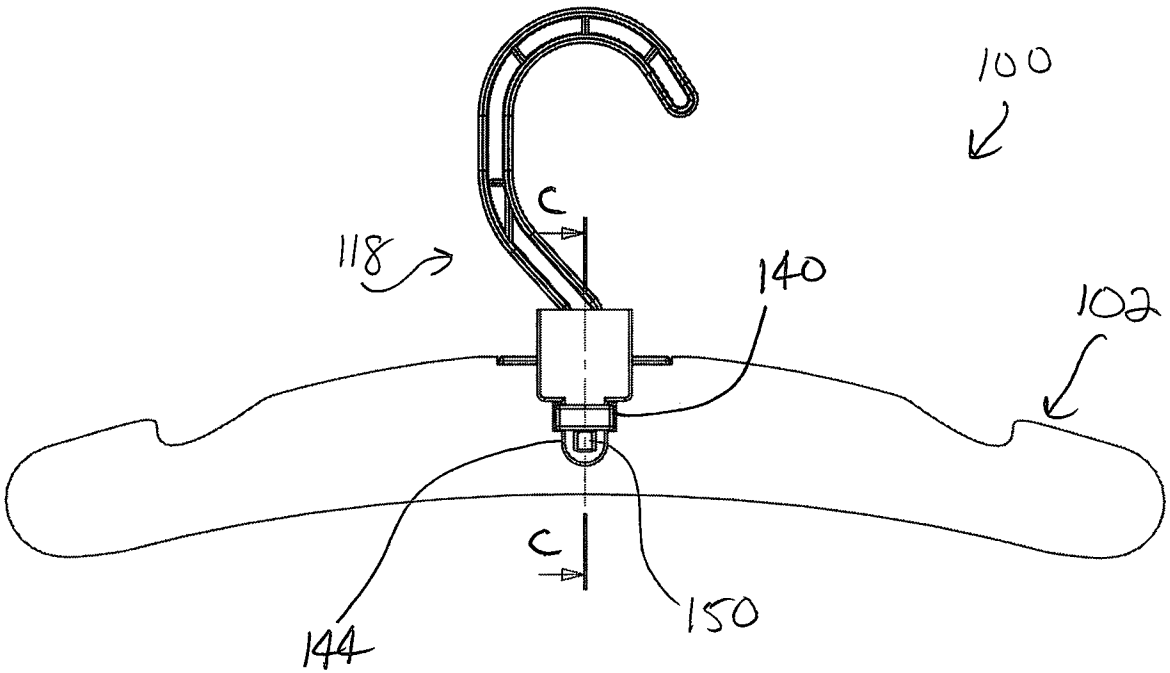
FIG. 13 is a view similar to FIG. 11 showing a second embodiment of the plastic hook in which the tab is located on the tongue of the lock member.
Figure 14:
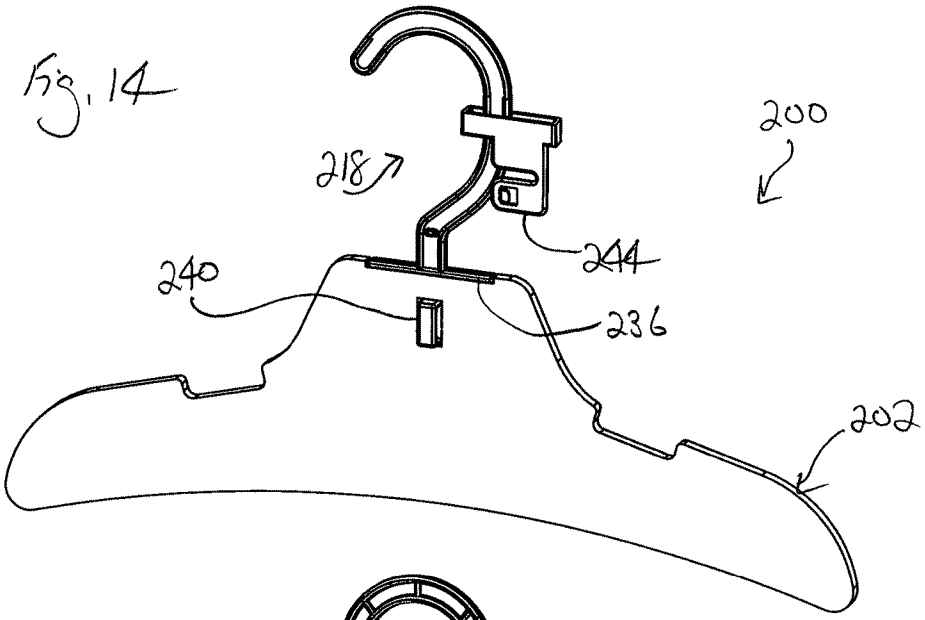
FIG. 14 is a front perspective view of a third embodiment of the plastic hook of the present invention in which the lock member is partially installed over the hook body.
Figure 15:
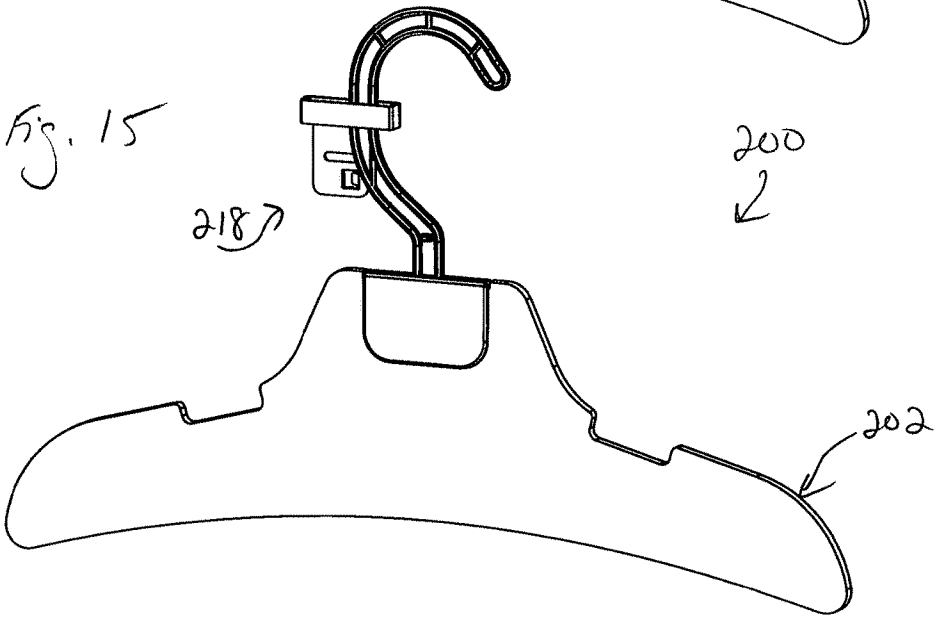
FIG. 15 is a rear perspective view of the plastic hook of FIG. 14.
Figure 16:
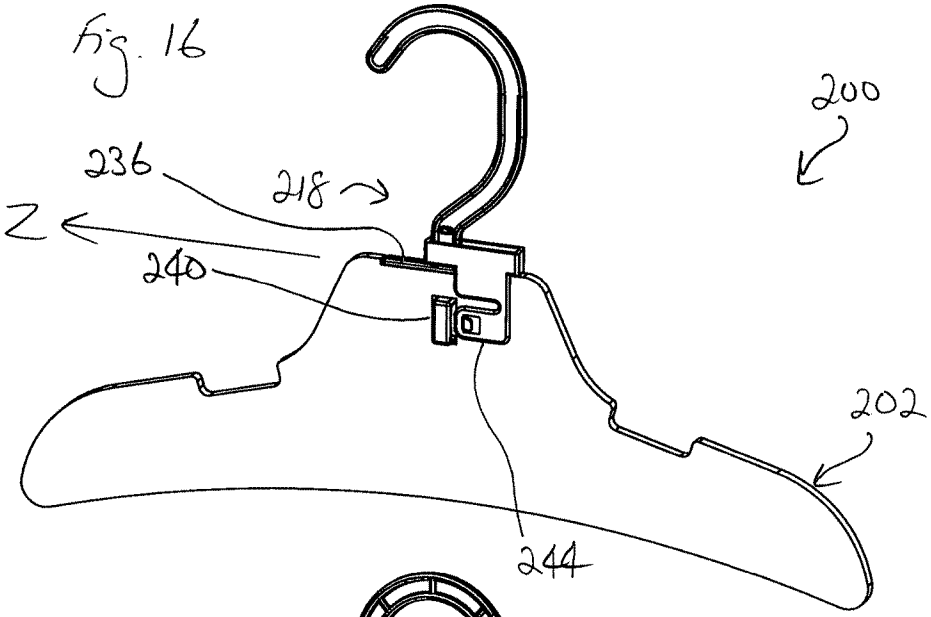
FIG. 16 is a view similar to FIG. 14 showing the lock member fully installed over the hook body but prior to engagement of the tongue with the collar extending through the paper hanger body.
Figure 17:
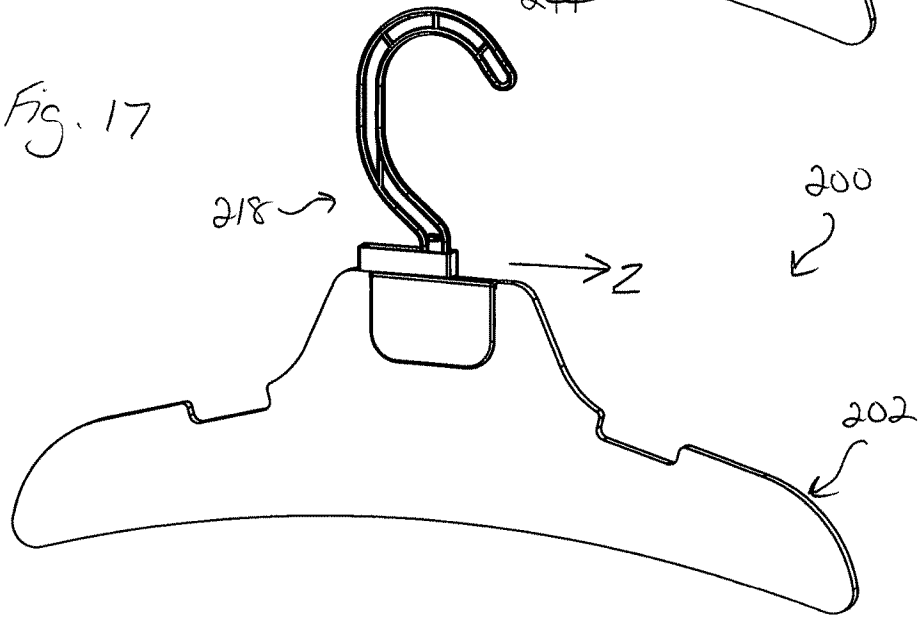
FIG. 17 is a view similar to FIG. 15 showing the lock member fully installed over the hook body but prior to engagement of the tongue with the collar extending through the paper hanger body.

A second embodiment of the present invention is shown in FIGS. 13 to 13*a*. Hanger 100 includes a paper hanger body 102 and a plastic hook 118. Paper hanger body 102 and plastic hook 118 are similar to paper hanger body 12 and plastic hook 18 with the exception that tab 150 is located on tongue 144 (rather than first planar surface 32), and that tab 150 engages collar 140 (rather than opening 48 in tongue 44).

A third embodiment of the present invention is shown in FIGS. 14 to 17. Hanger 200 includes a paper hanger body 202 and a plastic hook 218. Paper hanger body 202 and plastic hook 218 are similar to paper hanger body 102 and plastic hook 118 with the exception that collar 240 is oriented vertically and tongue 244 is located horizontally such that sizer body portion is moved horizontally along flange 236 in direction Z to engage tongue 244 with collar 240 thereby securing plastic hook 218 to paper hanger body 202.

As mentioned, the paper hanger body is preferably stamped from a paper stock material, i.e., cardboard, and the plastic hook components are preferably injection molded. The attachment opening in the paper hanger body is preferably formed during the stamping process. Thereafter, the plastic hook is assembled to the paper hanger body. In this regard, the hook body is oriented with the paper hanger body such that the collar on the hook body extends through the attachment opening in the paper hanger body. The lock member is then installed by inserting the hanging arm through the interior opening of the sizer body portion of the lock member, and sliding the lock member towards the second end of the hanging arm. The lock member is oriented such that the tongue is positioned to engage the collard. Finally, the tongue is inserted into the collar thereby securing the plastic hook to the paper hanger body.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

What is claimed is:

1. A plastic hook for a paper hanger body, said paper hanger body including a pair of opposing arms for supporting a garment thereon, said paper hanger body further including an attachment opening extending therethrough, comprising:

a plastic hook body, said hook body including a hanging arm having first and second ends, said first end of said hanging arm being sized to engage a rack, said hook body further including an attachment base, said attachment base including first and second opposing planar surfaces, said attachment base further including a flange located along one edge thereof and extending in a direction X perpendicular to said first planar surface, said second end of said hanging arm being attached to said flange, said attachment base further including a collar extending from said first planar surface in said direction X, said collar sized to extend through said attachment opening in said paper hanger body;

a lock member, said lock member including a sizer body portion and a tongue extending therefrom, said sizer body portion defining an interior opening sized and configured to allow passage of said hanging arm therethrough to a first position in which said sizer body portion is positioned at said second end of said hanging arm, said tongue extending from said body portion in a direction substantially parallel to the direction of passage through said interior opening, said tongue being sized and configured to engage said collar thereby securing said plastic hook to said paper hanger body.

2. The plastic hook according to claim 1, wherein said tongue includes a tab for engaging said collar.

3. The plastic hook according to claim 1, wherein said tongue includes an opening, and further comprising a tab positioned on said first planar surface of said attachment base for engaging said opening in said tongue.

4. The plastic hook according to claim 1, wherein said attachment opening in said paper hanger body is rectangular, and wherein said collar defines a rectangular boundary which substantially corresponds in size and shape to said rectangular attachment opening, said collar being sized to maintain frictional engagement with said attachment opening when said collar extends therethrough.

5. The plastic hook according to claim 1, wherein at least an edge of said sizer body portion contacts said flange when said lock member is in said first position.

6. The plastic hook according to claim 1, wherein said tongue engages said collar when said lock member is in said first position.

7. A garment hanger, comprising:

a paper hanger body, said paper hanger body including a pair of opposing arms for supporting a garment thereon, said paper hanger body further including an attachment opening extending therethrough;

a plastic hook including a plastic hook body and a lock member;

said hook body including a hanging arm having first and second ends, said first end of said hanging arm being sized to engage a rack, said hook body further including an attachment base, said attachment base including first and second opposing planar surfaces, said attachment base further including a flange located along one edge thereof and extending in a direction X perpendicular to said first planar surface, said second end of said hanging arm being attached to said flange, said attachment base further including a collar extending from said first planar surface in said direction X, said collar sized to extend through said attachment opening in said paper hanger body;

said lock member including a sizer body portion and a tongue extending therefrom, said sizer body portion defining an interior opening sized and configured to allow passage of said hanging arm therethrough to a first position in which said sizer body portion is positioned at said second end of said hanging arm, said tongue extending from said body portion in a direction substantially parallel to the direction of passage through said interior opening, said tongue being sized and configured to engage said collar thereby securing said plastic hook to said paper hanger body.

* * * * *